United States Patent [19]

Benz et al.

[11] 4,160,602

[45] Jul. 10, 1979

[54] MULTI-CHAMBER PACK

[75] Inventors: Maurice E. Benz, Riehen; Peter Bähler, Seltisberg, both of Switzerland

[73] Assignee: Ciba-Geigy AG, Basel, Switzerland

[21] Appl. No.: 824,666

[22] Filed: Aug. 15, 1977

[30] Foreign Application Priority Data

Aug. 18, 1976 [CH] Switzerland ..... 10513/76
Feb. 7, 1977 [CH] Switzerland ..... 1452/77

[51] Int. Cl.[2] ..... G05D 11/00; B65D 25/08; B01F 7/20

[52] U.S. Cl. ..... 366/162; 206/222; 366/602; 366/192; 366/247; 366/314; 366/331

[58] Field of Search ..... 206/219, 220, 222; 220/271; 366/602, 241, 143, 247, 279, 289, 290, 162, 192, 150, 314, 325, 328, 331

[56] References Cited

U.S. PATENT DOCUMENTS

| | | | |
|---|---|---|---|
| 224,848 | 2/1880 | Scudder | 366/247 |
| 2,401,986 | 1/1946 | Plett | 259/113 |
| 2,721,552 | 10/1955 | Nosik | 206/222 |
| 3,134,577 | 5/1964 | Bollmeier | 259/71 |
| 3,153,531 | 10/1964 | Cook | 259/113 |
| 3,425,598 | 2/1969 | Kobernick | 206/222 X |
| 3,456,923 | 7/1969 | Zeuzem | 366/335 |
| 3,537,605 | 11/1970 | Solowey | 215/6 |
| 3,726,434 | 4/1973 | Platt | 220/271 |
| 3,756,571 | 9/1973 | Winberg | 366/602 |

FOREIGN PATENT DOCUMENTS

| | | | |
|---|---|---|---|
| 1296606 | 1/1966 | Fed. Rep. of Germany | 215/6 |
| 44939 | 8/1970 | Fed. Rep. of Germany | 215/6 |
| 2244600 | 9/1972 | Fed. Rep. of Germany | 259/113 |
| 2350987 | 11/1973 | Fed. Rep. of Germany | 215/6 |
| 2451167 | 10/1974 | Fed. Rep. of Germany | 215/6 |
| 2459683 | 10/1975 | Fed. Rep. of Germany | 206/222 |
| 67366 | 11/1954 | France | 215/6 |
| 2159210 | 6/1973 | France | 215/6 |
| 2289407 | 10/1974 | France | 215/6 |

*Primary Examiner*—Edward J. McCarthy
*Attorney, Agent, or Firm*—Harry Falber

[57] ABSTRACT

A multi-chamber pack comprising at least two chambers separated by a frangible partition and externally operable means for breaking the partition, and means for mixing the contents of the chambers. The mixing means are formed by an agitator element operative by rotation, more particularly one or more vanes, said element being disposed rotatably in one of the chambers. An actuating element is disposed rotatably on the outside of the pack and is coupled to the agitator element so as to rotate therewith and serves to drive the latter. The means for breaking the partition are in the form of a push rod fixed to an inwardly deformable wall part of the pack.

16 Claims, 2 Drawing Figures

MULTI-CHAMBER PACK

FIELD OF THE INVENTION

This invention relates to a multi-chamber pack comprising at least two chambers separated by a frangible partition, externally operable means for breaking the partition, and means for mixing the contents of the two chambers.

Packs of this kind are used more particularly for two-component plastics.

PRIOR ART

A pack of this kind is disclosed in U.S. Pat. No. 3,153,531, and comprises a cylindrical vessel divided into two chambers by a relatively flat piston. The latter is in the form of a spoked wheel, the spaces between the spokes being closed by a thin membrane or foil and the piston is slideable by way of a piston rod passing through one of the cylinder end walls. In order to mix the contents of the two chambers e.g. resin and curing agent, the membrane closing the openings in the piston is broken by subjecting the piston to an axial load, and then the piston is moved to and fro in the container.

Another two-chamber pack is disclosed in U.S. Pat. No. 3,134,577. This pack has two containers disposed one inside the other to form two axially adjacent cylindrical chambers, and a plate is disposed in one of the chambers extending at right angles to the chamber axis, the plate edge being constructed as a knife edge. The base of the inner container forms the partition between the two chambers. The plate is screwed to a piston rod extending axially through the outer end wall of one of the chambers. To break the partition, the plate is pressed axially against the partition by means of the piston rod and rotated so that the knife-edge forming the edge of the plate cuts through the partition. The contents of the two chambers are mixed in the same way as the pack according to U.S. Pat. No. 3,153,531, by axial reciprocation of the plate by means of the piston rod.

With these known packs it is inevitable that small quantities of the pack contents will pass out through the piston rod and soil the pack, particularly those parts of the piston rod which are situated outside the container. This is highly undesirable for hygienic reasons, particularly in connection with plastics.

OBJECT OF THE INVENTION

The object of this invention is to provide a multi-chamber pack, more particularly a two-chamber pack, which is of very simple design and accordingly cheap and yet satisfies all labour hygiene requirements. More particularly, the pack will prevent any contact between the skin and the pack contents and prevent fumes escaping.

SUMMARY OF THE INVENTION

To this end, according to the invention, the mixing means comprise a rotatable agitator disposed in one of the chambers and a rotatable actuator element disposed on the pack and coupled with the agitator element so as to rotate therewith. The construction of the mixing means as a rotatable agitator element gives a much more effective seal than in the conventional packs so that the pack according to the invention forms a system which is completely sealed off from the exterior and from which the pack contents cannot escape unintentionally.

BRIEF DESCRIPTION OF DRAWINGS

Preferred embodiments of the invention will be explained in detail hereinafter with reference to the accompanying drawings in which.

DETAILED DESCRIPTION OF PREFERRED EMBODIMENTS

Figure 1:
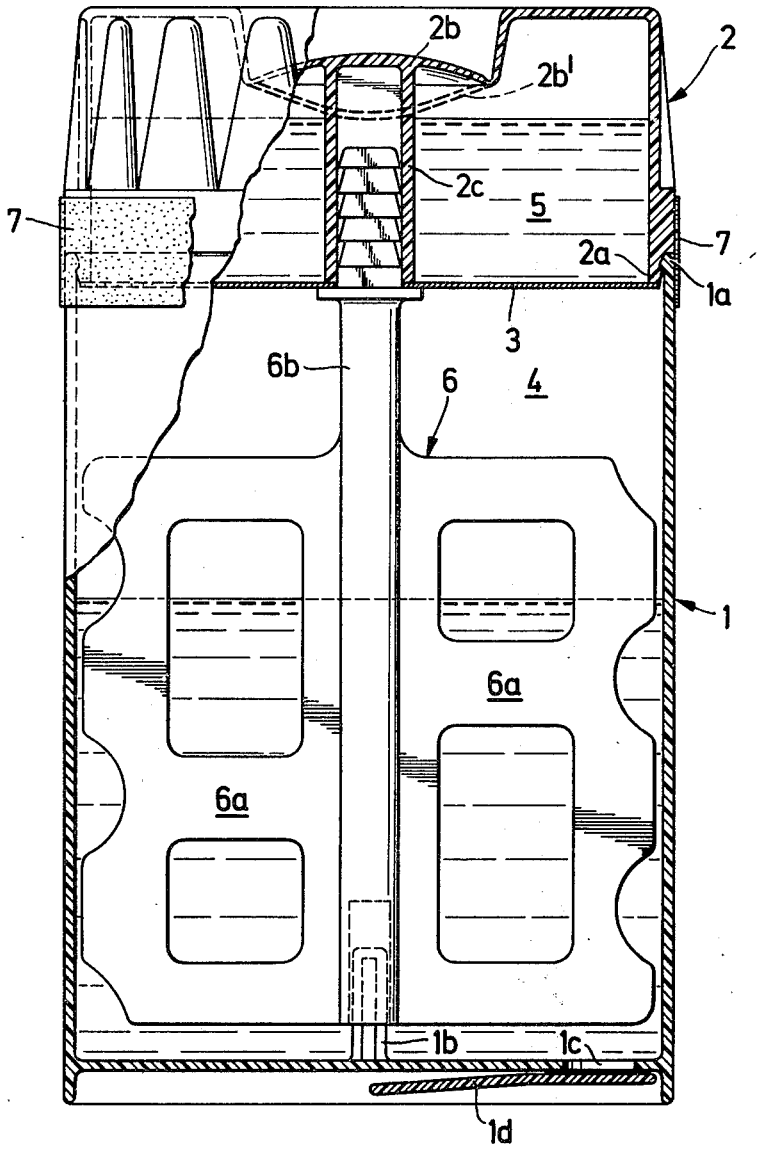
FIG. 1 is an axial section through a pack in accordance with this invention.

The pack shown in FIG. 1 comprises two coaxial cups 1 and 2 disposed with their openings facing one another and fixed to one another in sealing-tight relationship by their edges 1*a* and 2*a* respectively, but so as to be rotatable in relation to one another about their common axis. A frangible partition in the form of a thin metal or plastic foil 3 is clamped over the opening edge 2*a* of the top cup 2. This metal or plastic foil 3 divides the interior of the pack into two separate chambers 4 and 5.

Cup 2 has a central recessed end portion 2*b* with an outwardly curved portion which can be deformed inwardly into the broken-line position when resistance to deformation has been overcome. A coupling sleeve 2*c* of square cross-section extends axially from the central end zone 2*b* and its front end extends as far as the metal foil 3 to which it is glued in sealing-tight relationship.

An agitator 6 comprising two perforated vanes 6*a* and a shaft 6*b*, is disposed in the bottom cup 1 and is centred by an axial journal 1*b* extending upwards from the bottom of the cup. The top end of the shaft is ribbed and is positively and operatively held in the coupling sleeve 2*c* so that the agitator 6 is coupled to the top cup 2 and is rotatable therewith. The base of the bottom cup 1 also has an outflow aperture 1*c* and is closed by a welded-on tear-off cover 1*d* provided with a tab.

The joint between the two cups is covered by an adhesive strip 7 to provide better sealing properties before use and in order to secure the two cups 1 and 2 against unintentional relative rotation. Of course this object could be achieved by other means, e.g. by a tear-off ring or the like formed integrally after the style of the guarantee ring on bottle closures.

For the purposes of mixing the two chamber contents, the adhesive strip 7 is removed and the deformable central end part 2*b* of the top cup 2 is pressed in which then remains in the deformed position. Consequently, the coupling sleeve 2*c* moves down and bursts the metal foil 3 so that the contents of the top chamber 5 flow into the bottom chamber 4. The top cup 2 is then rotated in relation to the bottom cup 1 to actuate the agitator 6 therein so that the contents of the two chambers are mixed. When mixing is complete, the tear-off cover 1*d* is removed and the mixed contents of the pack discharged.

Figure 2:
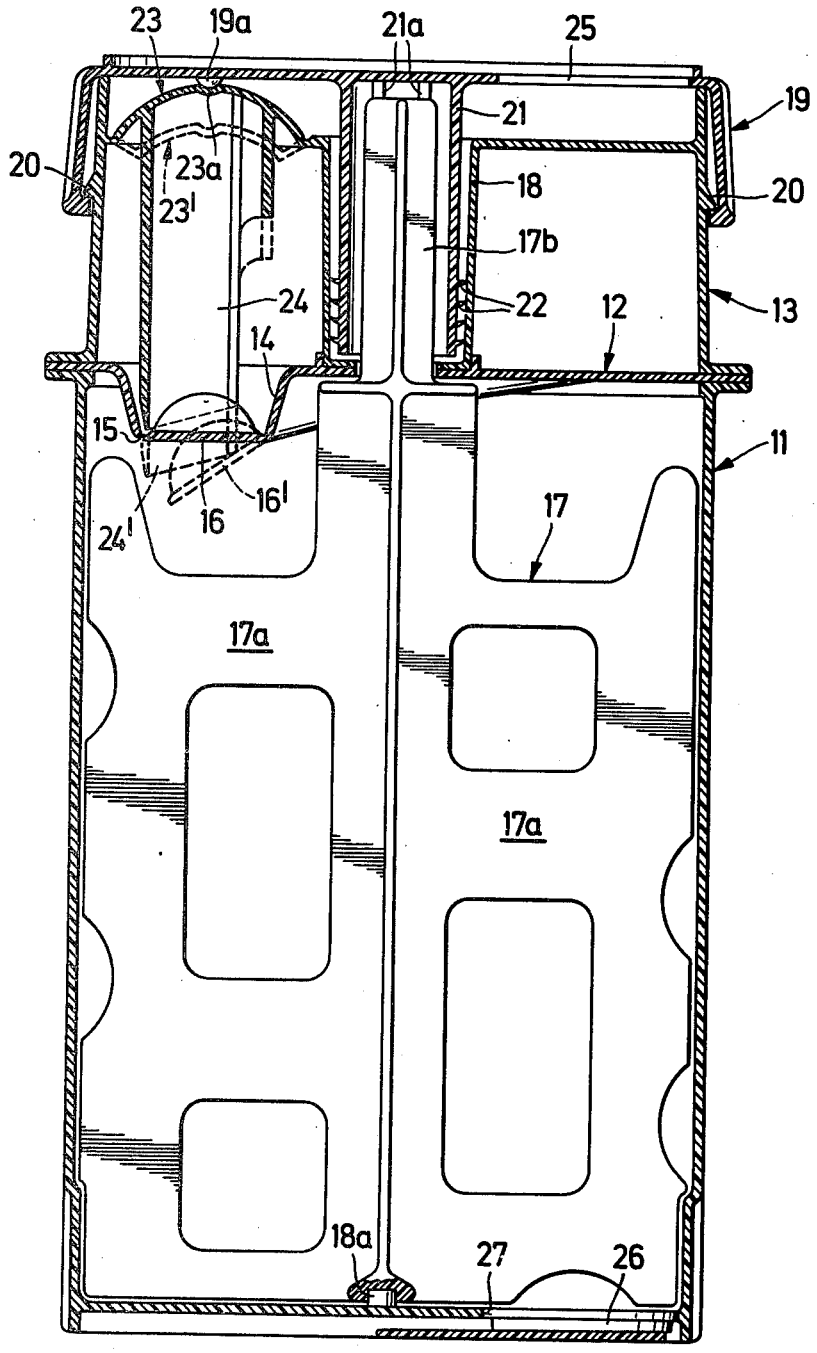
FIG. 2 is an axial section through a second form of pack in accordance with this invention.

The two-chamber pack shown in FIG. 2 comprises a mixing container 11 in the form of a cup which holds one of the components which are to be mixed together. The second container is formed by an annular cup 13 which is fixed with its open end downwards over a cover 12 which forms a partition between the two containers or reservoirs 11 and 13 and may be made of the same material as that of the partition 3 in the pack described with reference to FIG. 1. The cover 12 has a funnel-shaped recess 14 having a substantially circular frangible line 15 so that the bottom part 16 of the recess 14 can be relatively easily broken in the manner to be described and swung into the position 16 shown in dashed lines.

Container 11 contains an agitator 17 comprising two perforated vanes 17*a* and a shaft 17*b* of square cross-section, the agitator being centred by a journal projecting upwards from the base of the container 11. Shaft 17*b* passes through an opening in the cover 12 and extends through a tubular inner boundary wall 18 of the annular top container 13. A drive member 19 in the form of a cap for the agitator 17 is rotatably mounted on the container 13 and is prevented from being pulled off the container 13 by means of an annular bead 20 on the outer wall of container 13.

The drive member 19 is provided with a coaxial coupling sleeve 21 which engages the agitator shaft 17*b* and is sealed off from the inner wall 18 of the container 13 by means of sealing lips 22. Coupling sleeve 21 has longitudinal ribs 21*a*, which project radially inwards and which engage the drive shaft 17*b* of the agitator or engage therewith on rotation of the cap 19, thus coupling the agitator 17 to the cap 19 so as to rotate therewith.

Opposite the funnel-shaped recess 14, the end wall of the top container 13 has a raised deformable dome 23 which can be pressed by finger pressure inwardly into the broken-line position 23'. A small trough 23*a* is provided at the topmost point of the dome 23 and co-operates with a cam 19*a* on the cap 19 to form a resilient detent to secure the cap 19 against unintentional rotation.

A push rod 24 parallel to the container axis is fixed on the inside of the inwardly deformable dome 23 and its bottom end extends nearly as far as the base 16 of the funnel-shaped recess 14 in the cover 12. When the dome 23 is deformed inwardly, the push rod 24 slides down into the position 24' and in so doing breaks the base part 16 along the frangible line 15. In this way the contents of the top container 13 flow into the mixing container 11.

The drive cap 19 has a window 25 which is normally in the position shown. The dome 23 is thus covered with respect to the exterior by the cap 19 so that it cannot be unintentionally deformed. When the contents of the two containers are to be combined, cap 19 must first be turned until the window is exactly above the dome 23. The frangible partition between the two containers can then be broken in the manner described above and the contents of the two containers can be intimately mixed by turning the actuating cap 19. Discharge of the mixed container contents is similar to the embodiment described with reference to FIG. 1, through a opening 27 in the bottom of the mixing container which is closed by a push-in cover 26.

The above-described two-chamber pack can readily be enlarged or modified to form a three-chamber or multi-chamber pack. All that is required is to divide the top container 13 by one or more radial walls into two or more chambers, and provide each such chamber with a deformable wall and a push rod together with a frangible partition.

The multi-chamber pack according to this invention allows handling to be carried out satisfactorily from the working hygiene aspect and is therefore particularly suitable for substances which evolve noxious fumes or with which skin contact must be avoided.

What is claimed is:

1. A multi-chamber pack comprising a first and at least one further chamber, a frangible partition separating said chambers, means operable externally of said chambers for breaking the partition within said pack, an agitator disposed rotatably in said first chamber, and mounted on said pack an actuator element coupled to the agitator so as to rotate the latter.

2. A pack according to claim 1, wherein the actuator element is in the form of a cap and includes a window through which the means for breaking the partition are accessible when the actuator element is in a predetermined rotary position relative to the pack.

3. A pack according to claim 1, wherein said at least one further chamber includes a wall having a deformable zone, and said means for breaking the partition includes a push-rod cooperating with the deformable zone and movable by the deformation thereof, to break the partition.

4. A pack according to claim 2, wherein the deformable zone is arranged in the path of motion of the window of the cap.

5. A pack according to claim 3, wherein said deformable zone is so constructed that it remains in its deformed position after deformation.

6. A pack according to claim 2, including detent means for releasably retaining the actuator element in a position in which the window does not provide access to the partition breaking means.

7. A pack according to claim 3, wherein the partition has a frangible portion in the path of action of the push rod.

8. A pack according to claim 2 wherein said agitator has a shaft extending therefrom and the cap-shaped actuator element includes an axial coupling sleeve having one end closed and the opposite end open to fit over said shaft of the agitator in driving engagement therewith, said sleeve being rotatably and sealingly disposed in a tube-like chamber wall entrance.

9. A pack according to claim 1, wherein said first and said at least one further chambers are formed by a first and a second cup coupled together in sealing-tight relationship and rotatable one relative to the other, the partition extending over the opening of one of the two cups, and the agitator is disposed in the first cup and is coupled to the second cup so as to rotate therewith, in which case the second cup forms the actuator element.

10. A pack according to claim 9, including a sleeve coupled to said second cup and a shaft extending from said agitator, said sleeve coupling said shaft to said cup for rotation therewith.

11. A pack accordng to claim 10, wherein said partition is a thin membrane clamped over the open end of the second cup and is connected to the coupling sleeve in sealing-tight relationship, and wherein a central zone of the second cup is deformable to move the coupling sleeve axially to break the membrane.

12. A pack according to claim 11, wherein the central zone remains in its deformed position after deformation.

13. A pack according to claim 9, including releasable locking means on said cups to prevent relative rotation thereof.

14. A pack according to claim 1, including an outflow aperture and a closure therefor in the first chamber.

15. A pack according to claim 1, wherein the first chamber includes a bearing to support the agitator.

16. A pack according to claim 2 wherein said at least one further chamber includes a wall having a deformable zone, and said means for breaking the partition includes a push-rod co-operating with the deformable zone and movable by the deformation thereof, to break the partition, and wherein the deformable zone is arranged in the path of motion of the window of the cap.

* * * * *